US008844555B2

(12) United States Patent
Schneider

(10) Patent No.: US 8,844,555 B2
(45) Date of Patent: Sep. 30, 2014

(54) CO2 SYSTEM PRESSURE CONTROL VALVE

(75) Inventor: Daniel E Schneider, Worland, WY (US)

(73) Assignee: Bevtech, Incorporated, Fort Collins, CO (US)

( * ) Notice: Subject to any disclaimer, the term of this patent is extended or adjusted under 35 U.S.C. 154(b) by 0 days.

(21) Appl. No.: 13/549,422

(22) Filed: Jul. 14, 2012

(65) Prior Publication Data

US 2013/0180594 A1 Jul. 18, 2013

Related U.S. Application Data

(63) Continuation of application No. PCT/US2011/021311, filed on Jan. 14, 2011.

(60) Provisional application No. 61/294,906, filed on Jan. 14, 2010.

(51) Int. Cl.

| | |
|---|---|
| ***F17C 13/04*** | (2006.01) |
| ***B67D 1/00*** | (2006.01) |
| ***B67D 1/14*** | (2006.01) |
| ***B67D 1/12*** | (2006.01) |
| ***B67C 3/10*** | (2006.01) |

(52) U.S. Cl.

CPC ..... *B67C 3/10* (2013.01); *B67D 1/0057* (2013.01); *B67D 1/14* (2013.01); *B67D 1/1252* (2013.01)

USPC ..... 137/107; 137/266; 137/557; 141/351; 62/50.2; 62/50.7

(58) Field of Classification Search

USPC ..... 137/107, 266, 557; 141/1, 351; 62/50.2, 62/50.7

See application file for complete search history.

(56) References Cited

U.S. PATENT DOCUMENTS

| | | | | |
|---|---|---|---|---|
| 1,062,343 | A | | 5/1913 | Mahoney |
| 2,363,200 | A | | 11/1944 | Pew et al. |
| 2,813,402 | A | | 11/1957 | Poethig |
| 2,916,061 | A | * | 12/1959 | Hahn et al. ..... 137/625.12 |
| 3,018,635 | A | * | 1/1962 | Keckler ..... 62/50.4 |
| 3,392,537 | A | | 7/1968 | Woerner |
| 4,080,800 | A | * | 3/1978 | Spaulding et al. ..... 62/50.4 |
| 4,570,677 | A | * | 2/1986 | Roxton et al. ..... 137/557 |
| 4,683,921 | A | | 8/1987 | Neeser |
| 4,887,645 | A | * | 12/1989 | Kerger ..... 137/884 |

(Continued)

FOREIGN PATENT DOCUMENTS

| | | |
|---|---|---|
| JP | 3187052 B2 | 5/2001 |
| JP | 2004528969 | 9/2004 |
| JP | 2006264716 | 10/2006 |

*Primary Examiner* — John Rivell

(74) *Attorney, Agent, or Firm* — Blynn L. Shideler; Krisanne Shideler; BLK Law Group

(57) ABSTRACT

An apparatus and method for filling a CO2 system that provides carbonation and delivery of beverages to a user is provided together with a control valve for performing this method. The steps include: attaching a hose and pumping liquid carbon dioxide through an inlet fitting housed in a control valve assembly; causing the translation of a valve stem to isolate a gas port and a tank and a user port and directing the liquid carbon dioxide to a liquid port and a tank; and stopping the pumping of the liquid carbon dioxide upon reaching a pre-determined pressure and removing the hose allowing the translation of the valve stem to close the valve assembly from the atmosphere and allowing the liquid to boil to a gas to provide delivery and carbonation to the beverage.

8 Claims, 2 Drawing Sheets

(56) References Cited

U.S. PATENT DOCUMENTS

| | | | | |
|---|---|---|---|---|
| 4,936,343 | A | 6/1990 | Pruitt et al. | |
| 5,088,436 | A * | 2/1992 | Stritmatter | 62/50.7 |
| 5,113,905 | A | 5/1992 | Pruitt et al. | |
| 5,303,733 | A * | 4/1994 | Nelson | 137/557 |
| 5,358,009 | A * | 10/1994 | Cambell | 137/557 |
| 5,598,869 | A * | 2/1997 | Nelson | 137/557 |
| 6,601,618 | B2 | 8/2003 | Tsukano et al. | |
| 6,817,385 | B1 * | 11/2004 | Sloan et al. | 141/3 |
| 7,258,127 | B1 | 8/2007 | Schneider | |
| 7,766,309 | B1 * | 8/2010 | Smythe | 261/62 |
| 2002/0179177 | A1 | 12/2002 | Tsukano et al. | |

* cited by examiner

CO2 SYSTEM PRESSURE CONTROL VALVE

CROSS REFERENCE TO RELATED APPLICATIONS

The present application is a continuation of international patent application PCT/US2011/021311 which published as wo2011/088329 on Jul. 21, 2011, which publication is incorporated herein by reference in its entirety. International patent application PCT/US2011/021311 claims the benefit of U.S. provisional patent application Ser. No. 61/294,906, entitled "$CO_2$ System Pressure Control Valve", filed Jan. 14, 2010.

BACKGROUND OF THE INVENTION

1. Field of the Invention

This invention relates generally to CO2 system pressure control valve, for use primarily in the distribution of carbonated beverages.

2. Background Information

This invention relates to devices used in the carbonated beverage industry. This technology may have applications in additional other industries using carbon dioxide or similar systems, such as fire protection systems, welding, medical and other industries using compressed gases, such as represented in U.S. Pat. No. 2,363,200 relating to a gas dispensing system. U.S. Pat. Nos. 2,813,402, 3,392,537 and 6,601,618 disclose generic liquefied gas system relevant to wide applications. The discussion in this application, however, will relate primarily to the beverage dispensing industry.

The beverage industry uses carbon dioxide to carbonate and to move beverages from a storage tank to a dispensing area. For beverages such as beer, the beer can be contained in large kegs in a remote location, e.g., the basement or storage room, and the taps at the bar can dispense the beer. This method eliminates the storage of beer kegs in the bar area and allows the beer keg delivery and removal to occur in an area other than that in which patrons may be sitting. This type of system has existed for many years as evidenced in U.S. Pat. No. 1,062,343 which issued in 1913.

In order to get the beverages from the storage area to the serving area, prior art has used carbon dioxide among other gases. The carbon dioxide is generally delivered as a liquid in large heavy DOT cylinders and hooked to the dispensing system. When the tanks are hooked to the system, a certain volume, generally about one third of the tank, in a one tank system or one third of the tank volume in a multi-tank system is not filled with liquid. This allows the carbon dioxide to boil to a gaseous state. It is this gaseous state that is then used to carbonate and to move the desired beverage from the storage room or basement to the delivery area and provide much of the carbonation to the beverages.

One problem with this general system is that the carbon dioxide tanks must be changed or when the current tanks run out, they must be replaced with new tanks. This can be inconvenient and time consuming. If only one person is working, then they are required to leave the patron area and manually change the tank to allow the refreshments to continue to flow. In addition, delivery of additional filled tanks cannot always occur when they are needed if a user runs out in the late evening or during non-business hours. This problem can be somewhat lessened by using multiple liquid tanks, but this uses more space and can be more expensive to monitor and refill.

To refill or replace a tank, the system must generally be completely shut down, so no beverages can be served, and service or delivery personnel can move the full liquid carbon dioxide tanks into the business and remove the empty tanks. Generally several valves must be shut off while the tanks are changed. The business must wait until the changeover is complete before beverages can be served again.

Some systems exist where the physical changing of the tanks has been eliminated. This is done by delivering liquid carbon dioxide to the tanks or system pre-existing in the businesses. Generally a pump truck delivers the liquid carbon dioxide to a fill line plumbed to the outside of the building. The delivery personnel must then enter the establishment to close and adjust various valves. The system is then shut down and the dispensing of beverages must cease until the filling process is complete. Delivery personnel must then return to the truck and start the pump. They must then carefully watch the system to attempt to determine when the system is full. This can be difficult to determine with any uniformity. Some weeks a business may do very well with beverages and some weeks may not do so well. While an operator may get a general sense, it is difficult to determine without the trial and error method, when the system is full.

Some art uses relief valves to indicate when the system is full. This method of determining when the system is full is wasteful and can result in increased pressure hazards from over filling. Over filling can also result in the system not operating properly.

The system needs to maintain the proper liquid gas ratios and overfilling lessens the efficiency of the system as a whole. When the delivery person determines that the system is full, he/she must then reverse the actions taken on the valves and disconnect the truck from the system. While these types of systems do eliminate much of the inconvenience of physically changing out tanks, there are still significant disadvantages to this liquid delivery system common in the art.

U.S. Pat. No. 6,601,618, noted above and incorporated herein by reference, discloses a filling apparatus that is made up of a gas passage connected to a storage tank via a connection passage, a first gas valve that opens and closes the gas passage, a pressure gas passage connected to a pressure gas supply source, a pressure gas valve that opens and closes the pressure gas passage, an exhaust passage that allows an interior of a container to communicate with the exterior thereof, and an exhaust valve that opens and closes the exhaust passage. With this filling apparatus, before a pressurized filling operation, both the gas passage and the pressure gas passage are opened to pressurize the interior of the container with a carbonated gas supplied through both passages. Further, also before a un-pressurized filling operation, both the gas passage and the pressure gas passage are opened to perform a flushing operation in which droplets are discharged from the gas passage with air exhausted from the container into the storage tank via the gas passage. Then, after the filling operation, both the gas passage and the exhaust passage are opened to discharge a certain amount of filling liquid remaining in the gas passage, into the container.

U.S. Pat. Nos. 5,113,905 and 4,936,343, both of which are incorporated herein by reference, disclose a carbon dioxide fill manifold and method for using which is designed to provide an end-user with an uninterrupted supply of carbon dioxide gas, while at the same time eliminating the necessity of transporting individual, conventional pressurized bottles to be refilled. In a most preferred embodiment the carbon dioxide fill manifold includes a fill line valve connected to an atomizer for receiving a fill line and introducing liquid carbon dioxide into the atomizer, liquid cylinder ports provided in the atomizer for connecting a pair of liquid chambers to the atomizer and receiving and storing the liquid carbon dioxide, a gas cylinder port provided in the atomizer for connecting a vapor container to the atomizer and receiving gaseous carbon dioxide generated in the atomizer and a service line valve also connected to the atomizer for receiving a service lien valve and servicing the end user with gaseous carbon dioxide. A pressure actuated valve is also provided in the atomizer for periodically replenishing the supply of gaseous carbon dioxide from the liquid containers responsive to a selected pressure differential across the pressure actuated valve. A pressure relief valve is seated in the atomizer to guard against excessive liquid carbon dioxide system pressure.

U.S. Pat. No. 4,683,921, incorporated herein by reference, discloses a carbon dioxide fill manifold and method for using which is designed to provide a end-user with an uninterrupted supply of carbon dioxide gas, while at the same time eliminating the necessity of transporting individual, conventional pressurized bottles to be refilled. In a most preferred embodiment the carbon dioxide fill manifold includes a fill line valve connected to an atomizer for receiving a fill line and introducing liquid carbon dioxide into the atomizer, liquid cylinder ports provided in the atomizer for connecting a pair of liquid chambers to the atomizer and receiving and storing the liquid carbon dioxide, a gas cylinder port provided in the atomizer for connecting a vapor container to the atomizer and receiving gaseous carbon dioxide generated in the atomizer and a service line valve also connected to the atomizer for receiving a service lien valve and servicing the end user with gaseous carbon dioxide. A pressure actuated valve is also provided in the atomizer for periodically replenishing the supply of gaseous carbon dioxide from the liquid containers responsive to a selected pressure differential across the pressure actuated valve. A pressure relief valve is seated in the atomizer to guard against excessive liquid carbon dioxide system pressure.

There has been a need for a new approach for the liquid carbon dioxide and other pressurized gas delivery business. U.S. Pat. No. 7,258,127 addressed some of the problems with the prior art and provides a diverter valve, system and method for the delivery of gases or liquids where the delivery persons can fill the system without having to enter the building and the system can continue to deliver gas to the user. There is no interruption of service while the system is being filled. U.S. Pat. No. 7,258,127 is incorporated herein by reference in its entirety.

Japanese application 2004-528969 discloses a what is described as a carbonation chamber that is of general relevance to the present invention.

U.S. Patent publication 2002-0179177 and Japanese applications 2006-264716 and 3187052 may all be described as being generally related to the state of the art of the present invention.

SUMMARY OF THE INVENTION

In accordance with the invention, the present invention provides a control valve for use in a CO2 storage and distribution system that allows for a method for remote filling a CO2 system without interruption of CO2 service. The diverter valve disclosed in U.S. Pat. No. 7,258,127, incorporated herein by reference, can be viewed as forming the effective basis for the control valve of the present invention. The main operational concepts of this diverter valve have been incorporated into the integrated control valve of the present invention. The diverter valve of U.S. Pat. No. 7,258,127 has been modified as described herein to provide a comprehensive compact control valve structure for the system.

In one non-limiting embodiment of the invention, the invention provides a method for filling a system that provides for the carbonation and delivery of beverages, the system comprising at least one liquid carbon dioxide storage unit at least one gas carbon dioxide storage unit each coupled to a control valve assembly, comprising the steps of: attaching and pumping a supply of liquid carbon dioxide to an inlet line coupled to the control valve assembly; simultaneously, via operation of the control valve, coupling the inlet line, supply of liquid carbon dioxide and liquid carbon dioxide storage unit and isolating the gas carbon dioxide storage unit and associated user port from the inlet line, supply of liquid carbon dioxide and liquid carbon dioxide storage unit; pumping the liquid carbon dioxide until the storage tank, valve assembly and inlet line reach a pre-determined pressure; wherein the control unit is configured to allow users to the continue to obtain carbon dioxide from the gas carbon dioxide storage unit via the user port during filling at a predetermined pressure set by an adjustable pressure regulating valve in the control unit; and wherein the pressure is monitored within the control valve and at least one pressure relief valve is provided in the control valve; shutting off and disconnecting the supply of liquid carbon dioxide; and simultaneously, via operation of the control valve, closing the inlet line and coupling the liquid carbon dioxide storage unit with the gas carbon dioxide storage unit and which can supply carbon dioxide to the user via the user port during at the predetermined pressure set by the adjustable pressure regulating valve in the control unit.

The method for filling a system that provides for the carbonation and delivery of beverages according to the present invention may further include monitoring the pressure within the control valve at least at two distinct pressure locations, with each monitoring having a pressure relief valve coupled to the control valve. The method for filling a system that provides for the carbonation and delivery of beverages according to the present invention may further include a main CO2 shut off valve coupled to the user port of the control valve.

One non-limiting embodiment of the present invention provides a control valve assembly for receiving and directing the flow of pressurized liquid product to the at least one liquid storage tank and gaseous product to the at least one gaseous storage tank and to the user port for use by a user, the control valve assembly comprising: a valve body having an inlet port interconnected with at least one each of a liquid port, a gas storage port and a user port, the valve body having a plunger cavity with a plunger stop at one end; a valve stem; an inlet opening configured wherein the flow of pressurized liquid into the inlet opening causes the valve stem to translate toward and engage the plunger stop in the plunger cavity closing an interconnection of the gas storage port and user port with the liquid port and the inlet opening thereby allowing for filling and pressurizing the liquid storage tank and use of the gas storage port by a user, and wherein following filling of the liquid storage tank, the valve stem translates toward the inlet opening sealing off the inlet opening from the atmosphere; wherein the improvement comprises a user adjustable pressure regulator in the control valve to control the pressure of the gas supplied to the user; and at least one pressure gauge coupled to the control valve and configured to monitor pressure within the control valve and associated with at least one pressure relief valve is provided in the control valve.

The control valve assembly according to the present invention may further include two pressure gauges for monitoring the pressure within the control valve at least at two distinct pressure locations, with each pressure gauge having a pressure relief valve associated therewith coupled to the control valve. The control valve assembly according to the present invention may further include a main CO2 shut off valve coupled to the user port of the control valve.

The advantages of the present invention will be clarified in the description of the preferred embodiments taken together with the attached figures.

BRIEF DESCRIPTION OF THE DRAWINGS

Other objects and advantages appear in the following description and claims. The enclosed drawings illustrate some practical embodiments of the present invention, without intending to limit the scope of the invention or the included claims.

DETAILED DESCRIPTION OF THE PREFERRED EMBODIMENTS

Figure 1:
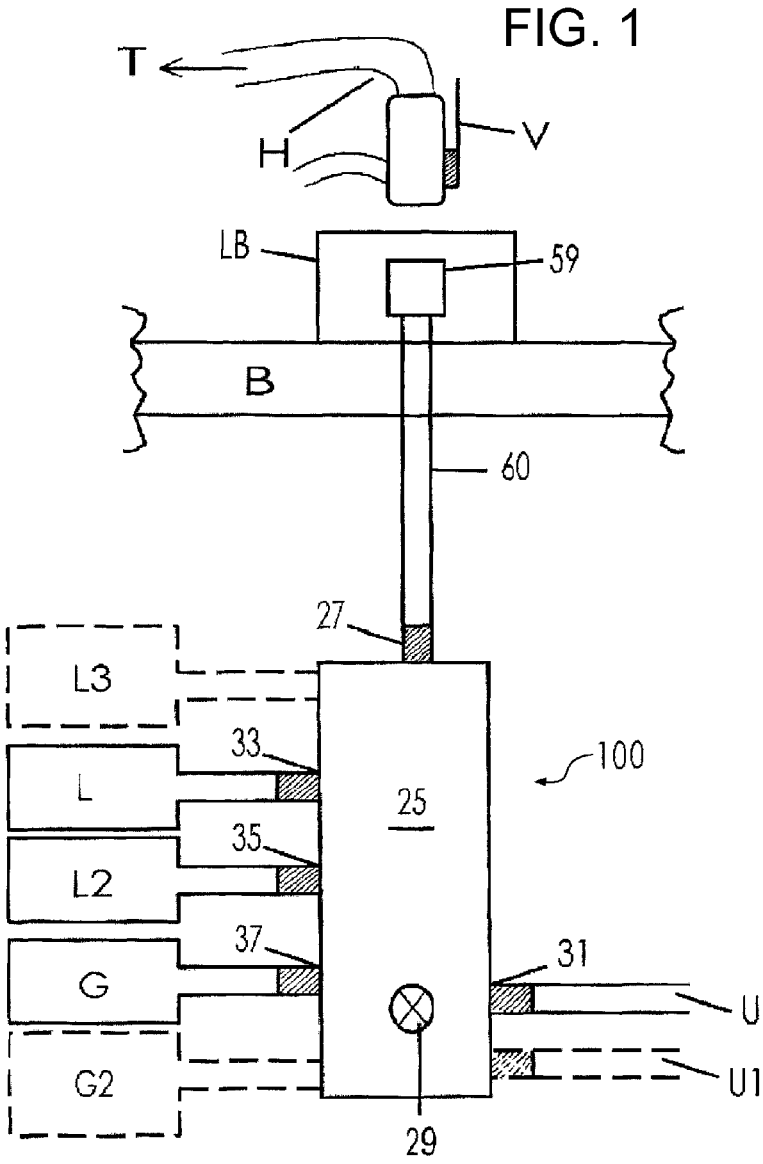
FIG. 1 schematically illustrates the general arrangement of the CO2 system according to the present invention.

As will be described in greater detail below the present invention provides In accordance with one aspect of the invention, the present invention includes a method for filling a CO2 system that provides carbonation and delivery of beverages to a user together with a control valve for performing this method. The CO2 system with diverter valve disclosed in U.S. Pat. No. 7,258,127 can be viewed as forming the effective basis for the CO2 system and control valve of the present invention. The main operational concepts of this diverter valve have been incorporated into the control valve of the present invention. The following reference numerals reflect element numbers shown in the figures of U.S. Pat. No. 7,258,127 which is incorporated herein by reference.

FIG. 1 schematically illustrates the general arrangement of the CO2 system according to the present invention and is essentially FIG. 20 of U.S. Pat. No. 7,258,127. The reference numerals of FIG. 1 are similar to those used in prior art FIG. 20 of U.S. Pat. No. 7,258,127 to more easily comport this disclosure with this earlier system. The CO2 system of the present invention includes a valve body 25/110 forming the basis of the CO2 system pressure control valve 100 of the present invention. The improvements to the control valve 100 over the diverter valve 25 of U.S. Pat. No. 7,258,127 are shown in detail in FIG. 2 discussed below. The valve body 25 which is primarily rectangular. The valve body 25 includes an inlet end having an inlet port 27.

The inlet port 27 is threaded and this is where the liquid carbon dioxide is delivered through an inlet fitting to the valve body 25. The inlet fitting is screwed into the inlet end of the valve body 25. The valve body 25 has a relief port 29 into which can be attached a relief valve (not shown in FIG. 1) in the event that the system surpasses some predetermined pressure, the relief valve would relieve the pressure in the system.

The valve body 25 contains at least one user port 31. The user port 31 is where the user connects the beverage dispensing system to allow gaseous carbon dioxide to carbonate and deliver the beverages.

The valve body 25 includes interconnected the gas storage port 37, second liquid port 35 and first liquid port 33. The details of the interior of the valve body 25 are illustrated in U.S. Pat. No. 7,258,127 incorporated herein by reference.

FIG. 1 shows an overview or block diagram of the complete system, not to scale. Filling the liquid tanks L, L2 requires that the hose H on the truck T be connected to the coupler 59 and the valve V on hose H be opened. Coupler 59 can be located outside of the building B, thus, the operator does not need to enter the building B to deliver the liquid and product can be delivered when the business or user is not open with no interaction from the user. The coupler 59 could also be located in a locked box LB with a door (not shown), to prevent tampering or vandals. It should be noted that no damage could occur to either the system inside the building or harm to a vandal because this embodiment maintains zero pressure on all fittings in the box LB and at the coupler 59 prior to connection to the truck T hose H. Once the liquid begins to flow through the inlet line 60 the change in pressure in the inlet line 60 causes the valve stem to translate towards the gas storage port 37, best shown in FIG. 18 of U.S. Pat. No. 7,258,127.

When the valve stem reaches the plunger stop, best shown in FIG. 18 of U.S. Pat. No. 7,258,127, the first end chamfer engages with the plunger stop and seals the gas storage port 37 and the user port 31 from the rest of the control valve 100. As the valve stem seals these elements from the rest of the system, the liquid carbon dioxide continues to flow through the inlet port 27 around the second end of the valve stem. The liquid continues through the slots into the plunger cavity and out the first liquid port 33 into the liquid tank L. The liquid carbon dioxide also flows from the plunger cavity through the fill channels out the second liquid port 35 to the liquid tank L2. When the liquid tanks L and L2 are full the truck T pump senses an increase in pressure and the pump shuts down.

When the hose H is disconnected, the sudden change in pressure causes the valve stem to translate toward the inlet fitting, best shown in FIG. 18 of U.S. Pat. No. 7,258,127. The lip and circumferential ring engage the chamfer of the inlet fitting sealing the system off from the coupler 59. The liquid in tanks L and L2 is then free to boil off or change to gas, and flow from the tanks L & L2 into plunger cavity and through gas storage port 37 for storage in tank G, or flow through the user port 31 to be utilized by the user U. It should be noted that when the valve stem engages the plunger stop while the liquid tanks L and L2 are filling, the system is still operational and gas is still capable of flowing to the user U. The gas can flow from the gas storage tank G through the gas storage port 37 through the user port 31. The dispensing system does not need to be shut down to be filled, and transparently, remains operational to the user.

While this embodiment shows two liquid tanks L & L2 it should be understood that many more liquid tanks (such as L3 in phantom) or only one tank could be utilized in other embodiments. Likewise, only one gas tank G is shown. It should be understood that many more gas tanks (such as G2 in phantom) could be utilized in other embodiments. Likewise, only one user port 31 is shown, there could be other user ports (U1 in phantom) branching off from the user port 31 in other embodiments. While many liquid tanks and gas tanks could be attached to the system it is helpful to maintain the gas storage tank to the liquid storage tank numbers in an approximate ratio of one to three.

The control valve 100 has the flexibility to be mounted almost anywhere inside the building B. The control valve 100 could be located on the interior wall of building B or mounted to the liquid or gas tanks. The control valve 100 could also be locked in a box (not shown) in the interior of building B to prevent tampering or vandals. Likewise, the control valve 100 could be located on the exterior of the building B if the user so chose.

Figure 2:
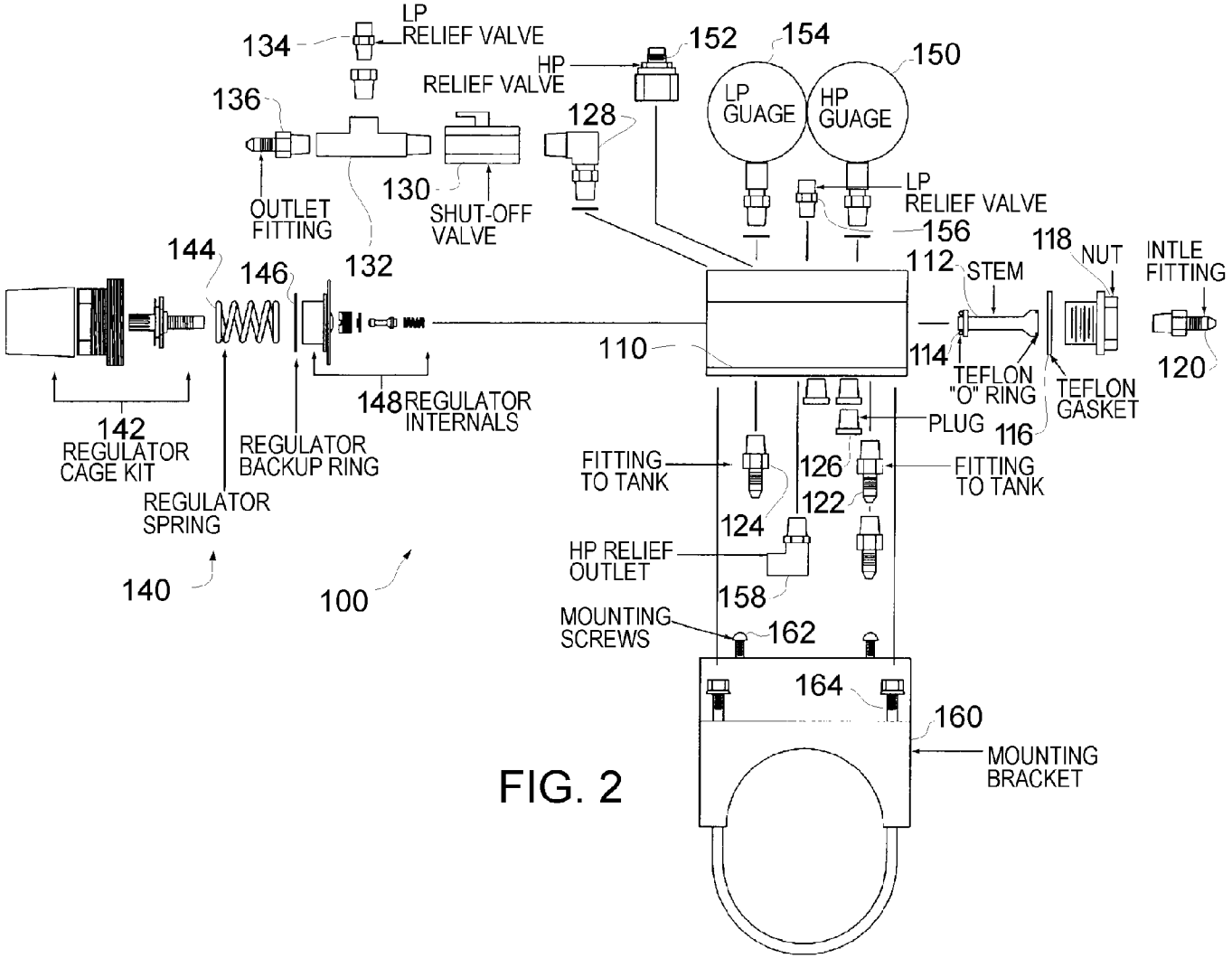
FIG. 2 schematically illustrates the CO2 system pressure control valve of the present invention.

FIG. 2 schematically illustrates the CO2 system pressure control valve 100 of the present invention wherein the improvements to the prior art diverter valve 25 are shown in connection with the valve body 110. The interior of the body 110 is the same as body 25 described in U.S. Pat. No.

7,258,127, other than listed herein, and the operation is not discussed further. The body 110 receives a stainless steel internal plunger or stem 112 that has been machined for a Teflon O-ring 114 per each end giving an efficient seal during the fill process. The stem 112 includes two additional flow-by holes than the stem of body 25 described in U.S. Pat. No. 7,258,127 giving a fast fill process. These design changes improve the operation of the system without changing the method of operation. A Teflon gasket 116 for threaded nut 118 with inlet fitting 120 complete the formation of inlet opening or port 27.

The body 110 includes fittings 122 and 124 for the respective ports 33, 35 and 37 for the liquid (L and L2) and gas (G) storage containers. Plugs 126 are provided to seal additionally provided but unused ports, such as for extra storage units G2 and L3.

Coupling 128 connects to outlet port 31 and is coupled to a ¼" ball valve 130 which is provided for emergency main CO2 supply shut down. Fitting 132 allows for the addition of a relieve valve 134 for the user line U and an conventional outlet fitting 136 for the user line U.

The valve body 110 has been machined to hold an adjustable $CO_2$ bonnet assembly or adjustable pressure regulator valve (or simply a regulator) 140 allowing the user to adjust the pressure in the supplied gas from 0-125 psi via a pressure locking dial knob. The components of assembly 140 can be grouped as follows a regulator cage kit 142, regulator spring 144, regulator back up ring 146 and regulator internals 148. The operation of the regulator 140 is generally known in the art.

The valve body 110 includes a high pressure monitoring gauge 150 monitoring pressure on the "high pressure" side of the valve 110 with a "high pressure" relief valve 152 (in place of 29) associated with the monitoring gauge 150 and configured to release pressure above a preset threshold. The high pressure relief valve 152 may be in the top rear machined edge of the valve body 110 as a a ¼" hole machined into the valve cavity to insert a high pressure relief valve 152 to control any high pressure increase which vents excess pressure to a fitting mounted into the bottom of the valve body which is connected to a vent line run to the outside of the install location connecting to the back side of the mounted fill box LB.

The valve body 110 further includes a "low" pressure monitoring gauge 154 monitoring pressure on the "low pressure" side of the valve 110 with a "low pressure" relief valve 156 associated with the monitoring gauge 154 and configured to release pressure in this segment of the valve 110 above a preset threshold. The "low pressure" relief valve 156 on the top of the valve body may be a ⅛" pipe thread hole and can control set pressures within the valve body per the regulated side.

The valve body 110 includes a manually actuated pressure relieve line or valve 158 for manual bleeding of the system if desired. The lines from 158, 156, 152 and 134 preferably lead to the outside lock box (LB) and the bleed line 158 can be actuated from there.

The body 110 is mounted through screws 162 to bracket 160 that can be easily secured to a desired base through attachment 164.

It is preferred that high pressure port holes are machined to a 7/16" O-ring boss thread for a no leak seal and to cut assembly time. Further the high pressure and low pressure gauges 150 and 154 are provided preferably with an easy alignment 7/16" o-ring boss seal thread. Further, the valve body 110 easily accommodates four spaced liquid ports (33, 35 and two more) along with an additional vapor port and the high pressure bleed port for line/valve 158. This design minimizes additional fittings required for larger storage capacity.

As described above, in one embodiment of the invention shown in the attached figures a high pressure and a low pressure gauge have been added to monitor the pressures per both high and low pressure ports/cavities within the valve body. Further the fill nut fitting is a 5 compression fitting adequately providing the fill volume of liquid $CO_2$ and minimizing total till time per stop and lower pressure levels on pump system. Further the Fill retainer nut 118 is equipped with a flat Teflon seal 116 as noted.

It is preferred if all instruction/port, labeling is laser etched on the valve body 110. Further the main body 110 is preferably machined from aluminum bar stock, anodized for color and then Teflon coated inside and outside for corrosion protection. Additionally in one embodiment of the invention shown in the attached figures a main mounting bracket is pressed from light gauge anodized aluminum and mounts solid to rear of valve body with two ¼"×½" hex headed steel bolts. The front and rear top edges have been machined at an angle to accommodate relief valves and etched lettering.

Further a lead seal has been attached between Main valve body and the fill retainer nut to identify tampering of the internal parts and or valve body in general for warranty protection and added safety. A 7/16" a-ring boss port is provided in the rear beveled edge for main regulated pressure supply and a ¼" ball valve is provided for emergency main co2 supply shut down connected to regulated pressure port One important aspect of the present invention is that the plunger of the control valve includes a Teflon o-ring at each end giving a more efficient seal during the fill process. The plunger further includes two additional flow-by holes added to the plunger fill side end giving a faster fill process.

According to one aspect of the present invention, all high pressure port holes have been machined to a common size, such as 7/16" O-ring boss thread, to provide a no leak seal and to cut assembly time.

The control valve of the present invention is provided with high pressure and low pressure gauges. These have been provided with an easy alignment 7/16" o-ring boss seal thread.

The control valve includes adjustable pressure regulation on the gas side of the system. Facing the front of the valve body the far left hand side has been machined to hold an adjustable $CO_2$ bonnet assembly. Pressure adjust is from 0-125 psi via a pressure locking dial knob.

On the bottom of the control valve body, four spaced liquid ports have been provided along with a vapor port and a high pressure bleed port.

The control valve further includes a low pressure relief valve to control set pressures within the valve body per the regulated side.

In accordance with one aspect of the present invention a high pressure relief valve is provided in the control valve to control any high pressure increase. This will vent excess pressure to a fitting mounted into the bottom of the valve body which may be connected to a vent line run to the outside of the install location connecting to the back side of the mounted fill box.

A high pressure and a low pressure gauge are included in the control valve to monitor the pressures per both high and low pressure ports/cavities within the valve body.

The fill retainer nut is equipped with a flat Teflon seal in one aspect of the present invention. In one aspect of the invention all instruction/port, labeling is laser etched on the body for easy viewing. The main body of the control valve may be machined from aluminum bar stock, which is then anodized for color and then Teflon coated inside and outside for corrosion protection and improved wear and sealing.

In accordance with one aspect of the present invention the main mounting bracket 160 may be pressed from light gauge anodized aluminum and mounts solid to rear of valve body with two ¼"×½" hex headed steel bolts.

In accordance with one aspect of the present invention, front and rear top edges of the body 110 may be machined at an angle to accommodate relief valves and etched lettering. In accordance with one aspect of the present invention, a lead seal has been attached between Main valve body and the fill retainer nut to identify tampering of the internal parts and or valve body in general. In accordance with one aspect of the present invention, a-ring boss port may be provided in the rear beveled edge for main regulated pressure supply.

The present invention has been described with reference to specific details of particular embodiments thereof. It is not intended that such details be regarded as limitations upon the scope of the invention. It will be apparent that various modifications can be made without departing from the spirit and scope of the present invention. The precise scope of the invention is to be defined by the appended claims and equivalents thereto.

What is claimed is:

1. A control valve assembly for receiving and directing the flow of pressurized liquid product to the at least one liquid storage tank and gaseous product to the at least one gaseous storage tank and to the user port for use by a user, the control valve assembly comprising:

a valve body having an inlet port interconnected with at least one each of a liquid port, a gas storage port and a user port, the valve body having a plunger cavity with a plunger stop at one end;

a valve stem;

an inlet opening configured wherein the flow of pressurized liquid into the inlet opening causes the valve stem to translate toward and engage the plunger stop in the plunger cavity closing an interconnection of the gas storage port and user port with the liquid port and the inlet opening thereby allowing for simultaneous filling and pressurizing the liquid storage tank and use of the gas storage port by a user, and wherein following filling of the liquid storage tank, the valve stem translates toward the inlet opening sealing off the inlet opening from the atmosphere;

wherein the improvement comprises a user adjustable pressure regulator in the control valve assembly to control the pressure of the gas supplied to the user; and at least one pressure gauge coupled to the control valve assembly and configured to monitor pressure within the control valve assembly and associated with at least one pressure relief valve which is provided in the control valve assembly, and wherein the user adjustable pressure regulator in the control valve assembly is axially aligned with the plunger cavity and the valve stem.

2. A control valve assembly according to claim 1 further including two pressure gauges for monitoring the pressure within the control valve assembly at least at two distinct pressure locations, with each pressure gauge having a pressure relief valve associated therewith coupled to the control valve assembly.

3. A control valve assembly according to claim 2 further including a main CO2 shut off valve coupled to the user port of the control valve assembly.

4. A control valve assembly according to claim 1 further including a main CO2 shut off valve coupled to the user port of the control valve assembly.

5. A control valve assembly according to claim 1 wherein a plunger of the control valve assembly includes a Teflon o-ring at each end thereof.

6. A control valve assembly according to claim 5 wherein the valve body of the control valve assembly is an anodized aluminum body with angled front and rear top surfaces.

7. A system for providing carbonation and beverage delivery of liquids to a user, the system comprising:

an inlet line connected to an inlet opening of a control valve having a valve stem having plurality of slots therein, a plunger cavity with a plunger stop and interconnecting passages, the interconnecting passages also connected to a first liquid port which is attached to a liquid storage tank, a gas storage port which is attached to a gas storage tank, a user port which is attached to the beverage delivery system, whereby liquid carbon dioxide in the inlet line causes the valve stem to translate and seat in the plunger stop isolating the user port and gas storage port and gas storage tank from the remaining system, the liquid carbon dioxide flows around the valve stem through the slots, out the liquid port and fills the liquid storage tank, when the system reaches a pre-determined pressure, the liquid carbon dioxide ceases to flow, the valve stem translates toward the inlet fitting sealing off the system from the atmosphere where the liquid carbon dioxide boils off and flows to the gas storage port and gas storage tank and through the user port for carbonation of the beverage and delivery of the beverage to the user, further including at least one pressure gauge coupled to the control valve and configured to monitor pressure within the control valve and associated with at least one pressure relief valve which is provided in the control valve, further including a user adjustable pressure regulator in the control valve which is axially aligned with the plunger cavity and the valve stem, and wherein a plunger of the control valve includes a Teflon o-ring at each end thereof.

8. A system for providing carbonation and beverage delivery of liquids to a user according to claim 7 wherein the control valve has a valve body which is an anodized aluminum body with angled front and rear top surfaces.

* * * * *